US007140922B2

(12) United States Patent
Luu et al.

(10) Patent No.: US 7,140,922 B2
(45) Date of Patent: Nov. 28, 2006

(54) MULTI-OUTLET AC/DC ADAPTER

(75) Inventors: Daniel V. H. Luu, Houston, TX (US); Lionel V. Luu, Tustin, CA (US)

(73) Assignee: Pacusma Company, Ltd., Kowloon (HK)

( * ) Notice: Subject to any disclaimer, the term of this patent is extended or adjusted under 35 U.S.C. 154(b) by 279 days.

(21) Appl. No.: 10/739,095

(22) Filed: Dec. 19, 2003

(65) Prior Publication Data

US 2004/0218411 A1 Nov. 4, 2004

Related U.S. Application Data

(60) Provisional application No. 60/434,436, filed on Dec. 19, 2002.

(51) Int. Cl.
*H01R 13/92* (2006.01)
*H01R 33/94* (2006.01)
*H01R 9/03* (2006.01)

(52) U.S. Cl. ..... 439/651; 439/956

(58) Field of Classification Search ..... 439/131, 439/172, 521, 651, 956, 652; 363/142–144, 363/146

See application file for complete search history.

(56) References Cited

U.S. PATENT DOCUMENTS

| | | | | |
|---|---|---|---|---|
| 5,967,807 | A * | 10/1999 | Wu | 439/131 |
| 6,061,261 | A * | 5/2000 | Chen et al. | 363/146 |
| 6,362,987 | B1 * | 3/2002 | Yurek et al. | 363/146 |
| 2004/0142601 | A1 * | 7/2004 | Luu | 439/652 |
| 2004/0218411 | A1 * | 11/2004 | Luu et al. | 363/146 |

* cited by examiner

*Primary Examiner*—James R. Harvey
(74) *Attorney, Agent, or Firm*—Dickstein Shapiro LLP

(57) ABSTRACT

An AC/DC adapter in which an AC to DC converter is incorporated in a multiple outlet wall adapter. The AC/DC adapter includes at least one standard AC plug receptacle and at least one DC receptacle. Electronic devices which require DC power can be plugged into to the AC/DC adapter by a power cord having a universal DC plug at one end and a connector or plug specific to the make and/or model of the electronic device at the other end. The universal DC plug corresponds with the DC receptacle provided on the AC/DC adapter. The adapter may be formed as one integrated unit or as a modular assembly which includes an AC module and a DC module. In the assembly, the AC and DC modules are constructed so that they can be fitted together and used as one conveniently sized unit, but modules can also be used independently of the other.

5 Claims, 5 Drawing Sheets

MULTI-OUTLET AC/DC ADAPTER

This application claims priority to U.S. Provisional Application Ser. No. 60/434,436, filed Dec. 19, 2002, the entire disclosure of which is hereby incorporated by reference.

FIELD OF THE INVENTION

The present invention is directed to AC/DC adapter devices providing a plurality of universal DC outlets.

BACKGROUND OF THE INVENTION

Electrical power accessed through electrical wall outlets is typically provided as AC current. When an electronic device requires DC power instead of AC, an AC/DC adapter must be provided to convert the AC current to DC current before supplying the power to the device.

The AC/DC adapter is typically embodied as a relatively large and heavy block which is either plugged directly into a wall outlet or a power strip, or is provided as part of the power cord of the device between the device and the plug. Both of these arrangements can be cumbersome, as the bulky adapters generally take up more space than would be desirable. For example, when an electronic device having an AC/DC converter plug is plugged into a wall outlet or a power strip, the converter plug often occupies the space over additional outlet receptacles or blocks the additional receptacles so as to prevent other devices from being plugged into the outlet receptacles adjacent to the one in which the adapter is plugged into. In the latter adapter arrangement, the adapter is typically placed on the floor, which often interferes with the arrangement of furniture, cleaning, and is unsightly. Thus, it is desirable to find a more convenient way to provide DC power from an AC outlet, preferably with the extra bulk associated with the power cord of each electronic device which requires DC power.

SUMMARY OF THE INVENTION

A first aspect of the present invention includes a wall adapter which is formed as a wall plate or a wall plate cover and has an AC/DC adapter incorporated with the wall plate or wall plate cover. The adapter includes an AC module embodied as a wall plate or wall plate cover, and a DC module.

The AC module includes plug prongs for being inserted into an outlet receptacle of the wall outlet to draw AC power, and at least one and preferably a plurality of AC plug receptacles for receiving the prongs of a plug for an electrical device. The AC module is configured such that when it is plugged into the wall outlet, whether the AC module is a wall plate or wall plate cover, only one outlet receptacle of a duplex wall outlet is occupied. The other receptacle of the wall outlet may be accessible through an opening formed in the AC module wall plate or wall plate cover. Such opening is aligned with the unoccupied wall outlet receptacle when the AC module is plugged into the other receptacle.

The DC module has plug prongs for being inserted into an outlet receptacle of a wall outlet, and is shaped to complement the shape and structure of the AC module. The DC module includes circuitry to convert the AC current drawn from the wall outlet to DC current, which may then be accessed via a plurality of universal DC plug receptacles provided in the DC module.

By providing the AC module and DC module as separate units, each unit may be used independently of the other. For example, the AC module may be used as a standard multi-outlet adapter that is plugged into one of the two outlet receptacles of a wall outlet, and which also allows access to the other outlet receptacle of the wall outlet through the opening of the AC module wall plate or wall plate cover. Similarly, the DC module may be used without the AC module by simply plugging the DC module directly into one of the outlet receptacles of a wall outlet and leaving the other receptacle unoccupied.

In a variation of this aspect of the invention, the AC/DC wall adapter may be constructed as an integrated unit instead of as an AC module and a separate DC module.

A second aspect of the invention provides a power strip having an AC/DC adapter function incorporated therein, and which includes a plurality of DC receptacles thereon for accessing the DC power. The power strip may also include at least one AC outlet receptacle as in typical power cords, additional functions such as surge protection, and additional types of receptacles, such as telephone or data line receptacles, coax connectors, etc.

Other features and advantages of the present invention will become apparent from the following description of the invention which refers to the accompanying drawings.

DETAILED DESCRIPTION OF THE INVENTION

Figure 5:
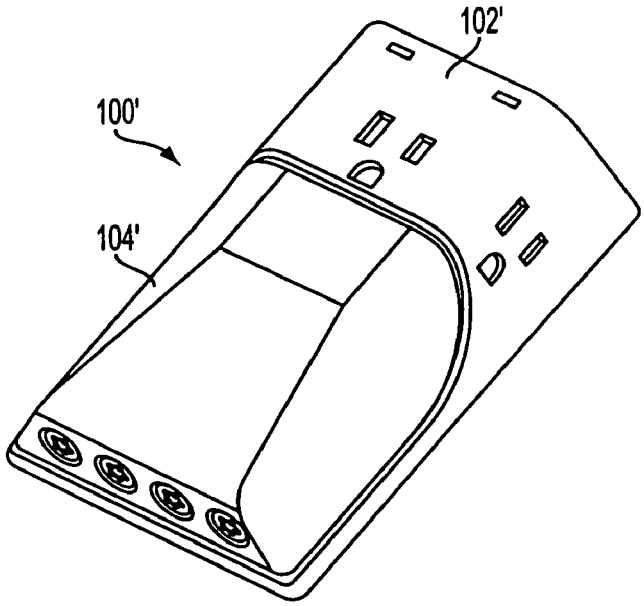
FIG. 5 shows another example of the first embodiment of the invention.
Figure 6:
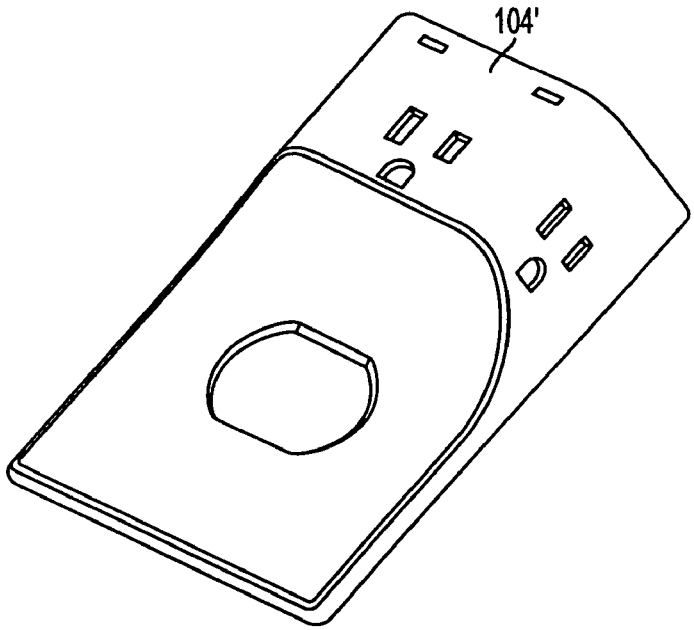
FIG. 6 shows the AC module portion of the invention shown in FIG. 5.

An example of a first embodiment of an AC/DC adapter assembly in accordance with the present invention is shown in FIGS. 1–4. The AC/DC adapter assembly 100 generally comprises an AC module 102 and a DC module 104. The AC module 102 and the DC module 104 are matingly shaped so that they can be fitted together in a complementary manner. For example, the AC module 102 has a receptacle portion 118 and a base portion 116. The DC module 104 is sized and shaped to fit on the base portion 116 and abutting the receptacle portion 118 so that the combined unit forms a block-like structure. Such complementary arrangement is further illustrated in FIGS. 5–6, wherein the top surface of the AC module 102' is curved to match the curve of the bottom surface of the DC module 104'.

The AC module 102 is preferably formed as a wall plate or wall plate cover, and includes plug prongs 108 (FIG. 2) for being inserted into an outlet socket of a wall outlet. If formed as a wall plate, the plug prongs 108 are plugged into one of the outlet receptacles of the wall outlet, and then the AC module 102 may be secured to the wall outlet box, in place of a standard wall plate, with a screw 118 similarly to the manner in which a typical wall plate is installed over the outlet. If, on the other hand, the AC module 102 is formed as a wall plate cover, the AC module 102 may be attached to the wall outlet over the existing wall plate by simply plugging the plug prongs 108 into one of the outlet receptacles of the wall outlet. Optionally, the edge 126 of AC module 102 may be formed to have a depth to be fitted or snapped on over and onto the existing wall plate so that the AC module 102 sits flush against the wall.

The AC module 102 also includes at least one and preferably a plurality of AC plug receptacles 106 formed on the receptacle portion 118 thereof, and an opening 112 formed on the base portion 116. The opening 112 is sized and shaped to correspond with the shape of an outlet receptacle of the wall outlet, and is positioned on the base portion such that when the AC module 102 is plugged into an outlet receptacle of the wall outlet, another outlet receptacle is exposed and accessible through the opening 112. Although not required, the base portion 116 may includes a locking mechanism 114 which engages the DC module 104 when it is placed in the proper position on the AC module 102, so that the DC module 104 and the AC module 102 can be maintained together as a unit even if neither unit is plugged into an outlet receptacle.

Optionally, the AC module 102 may also include additional functions, such as surge protection for electronic devices plugged into the AC plug receptacles 106. Indicators and control switches 110 may be provided on the housing of AC module 102 for controlling the additional functions.

The DC module 104 includes plug prongs 124 for being inserted into the outlet receptacle of the wall outlet exposed through the opening 112 of the AC module 102. The DC module thereby draws AC current from the wall outlet, converts the AC current to DC current, whereby the DC power can be accessed via at least one, and preferably a plurality of DC receptacles 120, 122 provided on the DC module 104.

While the AC module 102 and the DC module 104 are preferably constructed to be used together as a complete AC/DC adapter on a wall outlet, each module may optionally be used on a wall outlet without the other. Thus, when the AC module 102 is attached to the outlet without the DC module 104, the outlet receptacle exposed through the opening 112 is available for use as an additional plug receptacle for supplying AC power. Similarly, when the DC module 104 is attached to a wall outlet without the AC module 102, only one plug receptacle is available for supplying AC power.

Figure 7:
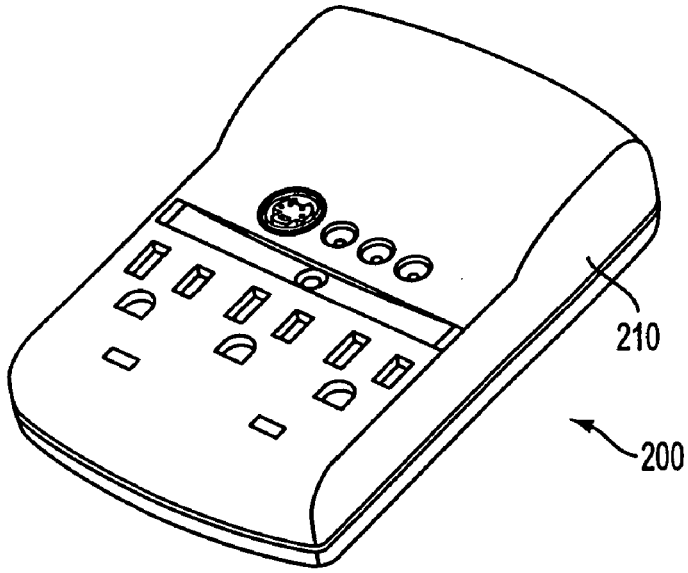
FIG. 7 shows an example of a second embodiment of the present invention.
Figure 8:
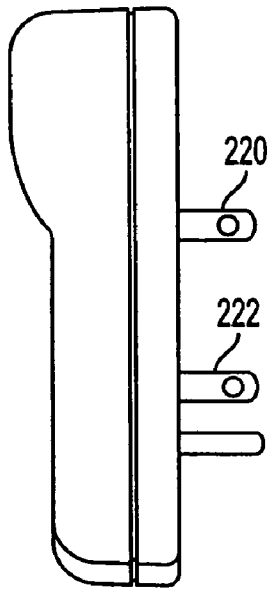
FIG. 8 is a side view of the invention shown in FIG. 7.

A second embodiment of the present invention is shown in FIGS. 7–8. The AC/DC adapter 200 of this embodiment is similar to the adapter assembly 100 of the first embodiment except that instead of providing the AC module as a separate unit from the DC module, the AC and DC functions are integrated into a single unit 210.

Figure 9:
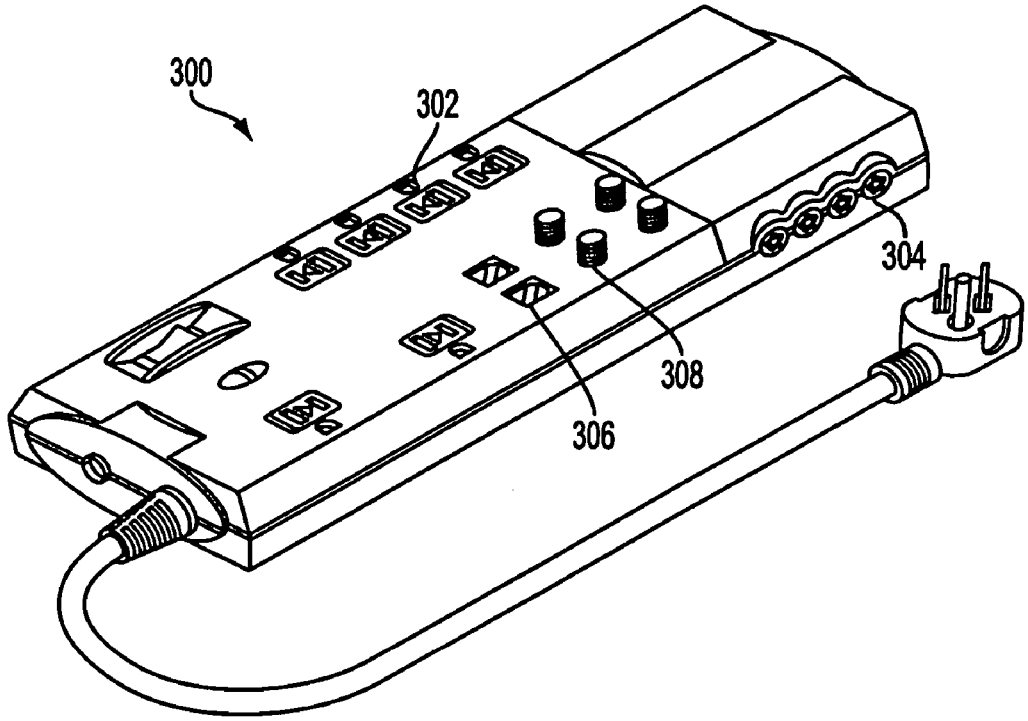
FIG. 9 shows an example of a third embodiment of the present invention.

In a third embodiment of the present invention, an AC/DC adapter is integrated into a power strip, as shown in FIG. 9. Like the adapters 100 of FIG. 1 and 200 of FIG. 5, the power strip 300 provides at least one, and preferably a plurality of AC plug receptacles 302, as well as at least one, and preferably a plurality of DC receptacles 304. If desired, the power strip 300 may also provide additional types of connection receptacles such as telephone/data connection receptacles 306, cable/video line connectors 308, and/or other input/output connectors for a variety of electronic communication devices or information processors, e.g. USB ports.

In the U.S., the AC power level output from a standard wall socket is 120 V, while in Europe and Asia, the standard AC power level is 220 V–240 V. Upon converting the AC current to a DC current, the AC/DC adapter also reduces the voltage level of the DC power supplied to each DC outlet receptacle to a level closer to the level of DC power used by most electronic devices which use DC power, e.g., 24 V. Even after reducing the voltage of the DC power, most electronic devices which use DC power typically still require further adjustment of the power level for safe and proper operation of the device. Moreover, different types of electronic devices use different voltage levels, and additional differences may be found between different brands and different models. For example, a PDA requires a different type of connector and a different power level requirement than a digital camera. Also, among the varieties of digital cameras, for example, model A of brand X may have a different voltage requirement from model B of brand X.

In order to fine tune the power level further to meet the requirements of an electronic device to be plugged into the adapter, therefore, each DC outlet receptacle is preferably used in conjunction with a DC-to-DC connection cable having at one end thereof a universal DC plug which corresponds with the DC outlet receptacle of the adapter. The other end of the connection cable includes or is attachable to a connector/plug which is specifically designed to fit the type and/or model of the electronic device. Thus, in the preferred embodiment in which the adapter outputs DC power at 24 V at each DC outlet receptacle, the device-specific connector adjusts the voltage level further from 24V to the required level.

Figure 1:
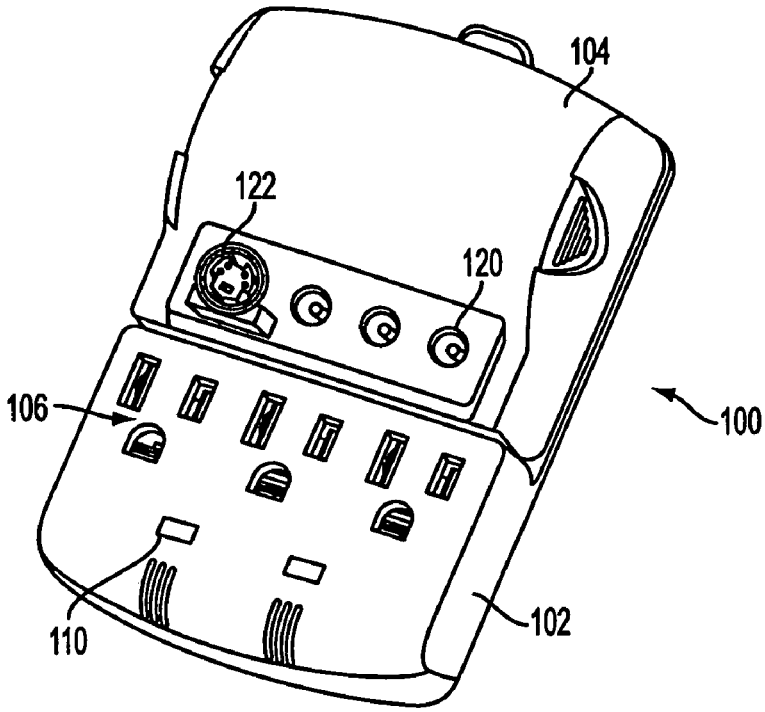
FIG. 1 shows an example of a first embodiment of the present invention.
Figure 2:
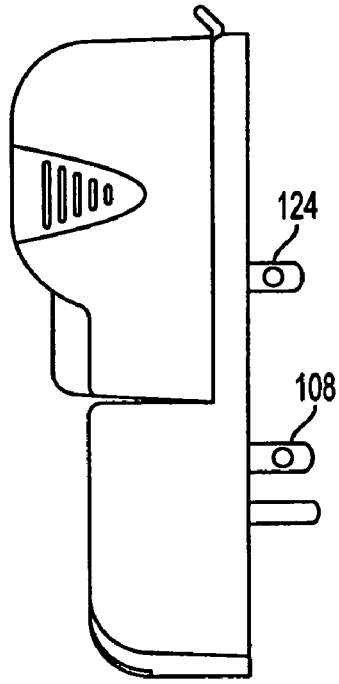
FIG. 2 is a side view of the invention shown in FIG. 1.
Figure 3:
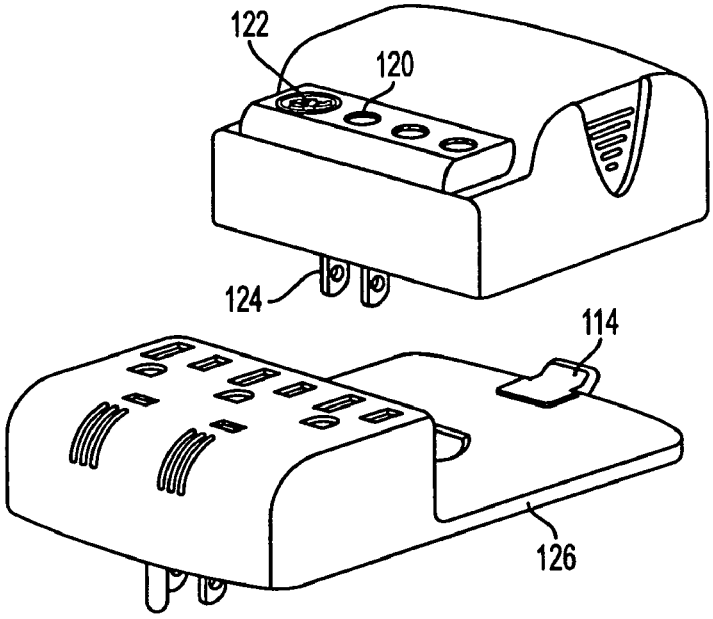
FIG. 3 is a further illustration of the invention shown in FIG. 1, showing the AC module as a separate unit from the DC module.
Figure 4:
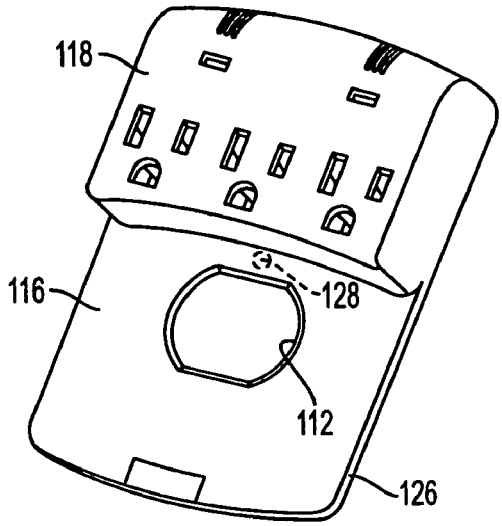
FIG. 4 shows the AC module portion of the invention shown in FIG. 1.

In the preferred embodiment, due to the relatively large amount of energy drawn by laptop computers in general, in order to avoid overloading the adapter, one of the DC outlet receptacles is specifically designated for laptop computers and requires a differently sized plug or differently configured plug than the other DC outlet receptacles (e.g., see receptacle 122 in FIG. 1). However, the manner of connecting a laptop computer is the same as described above, wherein a DC-to-DC connection cable is provided having a special laptop plug at one end for being inserted into the laptop outlet of the wall plate adapter, and a plug specifically designed for the particular make and model of laptop computer at the other end. In this manner, no more than one laptop computer can be accommodated by the adapter at any given time.

Other electronic features may also be incorporated into the AC module, DC module, integrated AC/DC adapter, or AC/DC power strip, such as a surge protection circuit, a timer, etc. by providing the appropriate circuitry in the housing of the respective unit.

A charger function may be provided in the AC/DC adapter unit of the present invention, to thereby enable the recharging of rechargeable batteries for devices such as mobile telephones, upon connecting the batteries to the AC/DC adapter unit with a cable having a standard DC plug at one end and a plug specific to the make and model of the mobile telephone at the other end.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A modular multi-outlet AC/DC adapter system comprising:

an AC module which is mountable to an electrical wall outlet, the AC module including a first set of plug prongs which can be inserted into an outlet receptacle of a wall outlet, and at least one AC outlet receptacle; and an AC to DC adapter including at least one DC outlet receptacle and a second set of plug prongs which can be inserted through an opening in the AC module and into an outlet receptacle of the electrical wall outlet, said AC to DC adapter having a shape which can be matingly fitted with the AC module.

2. The system according to claim 1, wherein the at least one DC outlet receptacle includes one DC outlet providing DC power at a first power level and at least one DC outlet providing DC power at a second power level.

3. The system according to claim 1, wherein the AC module is formed as a wall plate having an opening aligned with a second outlet receptacle of a wall outlet when the plug prongs of the AC module are inserted into a first outlet receptacle of a wall outlet.

4. The system according to claim 1, wherein the AC module is formed as a wall plate cover which is mountable over and onto a wall plate, and wherein the wall plate cover has an opening formed therein which is aligned with a second outlet receptacle of a wall outlet when the plug prongs of the AC module are inserted into a first outlet receptacle of a wall outlet.

5. The system according to claim 1, further comprising:

at least one connection cable each having a distal end thereof configured to be connected to the at least one DC outlet receptacle the at least one connection cable also having a device-specific connector attachable to the proximal end thereof for connecting to an electronic device.

* * * * *